US008798509B2

(12) United States Patent
Arimura

(10) Patent No.: US 8,798,509 B2
(45) Date of Patent: Aug. 5, 2014

(54) ELECTROPHOTOGRAPHIC IMAGE FORMING APPARATUS AND METHOD UTILIZING MISREGISTRATION PREVENTION PATTERN

(75) Inventor: Koji Arimura, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 336 days.

(21) Appl. No.: 13/240,336

(22) Filed: Sep. 22, 2011

(65) Prior Publication Data

US 2012/0114396 A1 May 10, 2012

(30) Foreign Application Priority Data

Nov. 9, 2010 (JP) ..... 2010-251276

(51) Int. Cl.
*G03G 15/01* (2006.01)
*G03G 15/16* (2006.01)

(52) U.S. Cl.
USPC ..... 399/301; 399/296

(58) Field of Classification Search
USPC ..... 399/6, 194, 296, 301
See application file for complete search history.

(56) References Cited

U.S. PATENT DOCUMENTS

| | | | | |
|---|---|---|---|---|
| 6,091,922 | A | 7/2000 | Bisaiji | |
| 6,259,879 | B1 * | 7/2001 | Bisaiji | 399/296 |
| 6,434,354 | B2 * | 8/2002 | Bisaiji | 399/296 |
| 6,694,114 | B2 * | 2/2004 | Matsuduki | 399/66 |
| 6,944,418 | B2 | 9/2005 | Tamaoki | |
| 2004/0091291 | A1 | 5/2004 | Tamaoki | |
| 2007/0285490 | A1 * | 12/2007 | Tamaoki | 347/232 |
| 2008/0131151 | A1 * | 6/2008 | Tamaoki | 399/49 |

FOREIGN PATENT DOCUMENTS

| | | | |
|---|---|---|---|
| JP | 11-052758 | A | 2/1999 |
| JP | 2004-151588 | A | 5/2004 |

* cited by examiner

*Primary Examiner* — Sandra Brase
(74) *Attorney, Agent, or Firm* — Fitzpatrick, Cella, Harper & Scinto

(57) ABSTRACT

An image forming apparatus includes a detection unit configured to detect a position where a toner image of a color component other than the color component of a misregistration prevention pattern and the toner image of the misregistration prevention pattern overlap each other on a surface of an image carrier; and a control unit configured to control to form the misregistration prevention pattern on the surface of the image carrier except for the overlapping position detected by the detection unit, and not to form the misregistration prevention pattern at the overlapping position on the surface of the image carrier.

3 Claims, 7 Drawing Sheets

ELECTROPHOTOGRAPHIC IMAGE FORMING APPARATUS AND METHOD UTILIZING MISREGISTRATION PREVENTION PATTERN

BACKGROUND OF THE INVENTION

1. Field of the Invention

The present invention relates to an image forming apparatus and an image forming method using an electrophotographic method. Particularly, the present invention relates to prevention of misregistration of image formation arising from a toner image.

2. Description of the Related Art

Recently, there is a strong demand for image forming apparatuses to downsize in terms of saving more space while increasing image quality and productivity. As a method for downsizing, there is proposed an image forming apparatus that adopts a kind of intermediate additive color mixing, that is, juxtaposing a color mixture by arranging a plurality of exposure devices and a plurality of developing units side by side on one photosensitive member. This image forming apparatus arranges yellow, cyan, magenta, and black toners side by side within, for example, an n x m (n and m are integers) dot matrix which forms one pixel. The image forming apparatus forms an image by mixing of reflected light beams of the respective toners, that is, juxtaposed color mixture which is a kind of intermediate additive color mixing. This method can greatly downsize the apparatus because it can reduce photosensitive members and charging devices which are necessary for respective color stations in a conventional image forming apparatus.

When the image forming apparatus uses a transfer medium with high slipperiness on the paper surface such as coated paper, slipperiness between the image carrier and the transfer medium changes in the image traveling direction depending on the presence/absence of a toner image. The change of the slipperiness generates a velocity difference between the image carrier and the transfer medium. The generation of the velocity difference between the image carrier and the transfer medium to delay the traveling of the transfer medium results in a local shrinkage in the sub scanning direction within the print image. If the rotational velocity of the image carrier varies and decreases with respect to the transfer medium, an image failure such as a local stretch in the sub scanning direction within the print image or an image streak caused by a blur of image exposure on the image carrier may occur.

To prevent an image failure caused by the slipperiness difference, Japanese Patent Laid-Open No. 11-52758 discloses an arrangement which prints image misregistration prevention dots in almost all the image region.

In Japanese Patent Laid-Open No. 2004-151588, a normal image region where a developer image is formed based on print image information is formed. In addition, a dot dispersed image in which dot developer images each having an area of one or more dots are dispersed is formed upstream of the normal image region in the intermediate transfer medium moving direction within the region of a transfer medium P. Of dots formed in the dot dispersed image forming region, dots whose developer image density based on print image information is lower than a predetermined density form a dot developer image at the predetermined density. Dots whose developer image density is higher than the predetermined density form a dot developer image at a density complying with external information.

However, the image forming apparatus using juxtaposed color mixture cannot superpose dots formed by toner on each other to prevent an image failure caused by the velocity difference between the image carrier and the transfer medium in image formation, which is a problem to be solved by the present invention. Even if it is determined that the developer density of a dot based on print image information is low, no dot dispersed image developer can be superposed on the dot, unlike Japanese Patent Laid-Open No. 2004-151588.

When forming a predetermined dot dispersed image, if a dot dispersed image is formed preferentially to a dot which overlaps print image information, the dot pattern portion of the dot dispersed image seems decolorized at the solid portion of the print image. The image loss roughens the image and degrades the image quality.

SUMMARY OF THE INVENTION

The present invention provides to prevent an image loss caused by a misregistration prevention dot while preventing misregistration between an image carrier and a transfer medium in transfer in an image forming apparatus using juxtaposed color mixture.

According to one aspect of the present invention, there is provided an image forming apparatus which includes an image carrier, a charging unit that charges a surface of the image carrier, exposure units that form latent images of respective color components on the surface of the image carrier, developing units that develop the latent images formed by the exposure units into toner images, and a transfer unit that transfers the toner images onto a transfer medium, and which forms a misregistration prevention pattern by a toner image of a predetermined color component to prevent misregistration of image formation in transfer by the transfer unit, comprising: a detection unit configured to detect a position where a toner image of a color component other than the color component of the misregistration prevention pattern and the toner image of the misregistration prevention pattern overlap each other on the surface of the image carrier; and a control unit configured to control to form the misregistration prevention pattern on the surface of the image carrier except for the overlapping position detected by the detection unit, and not to form the misregistration prevention pattern at the overlapping position on the surface of the image carrier.

According to another aspect of the present invention, there is provided an image forming method in an image forming apparatus which includes an image carrier, a charging unit that charges a surface of the image carrier, exposure units that form latent images of respective color components on the surface of the image carrier, developing units that develop the latent images formed by the exposure units into toner images, and a transfer unit that transfers the toner images onto a transfer medium, and which forms a misregistration prevention pattern by a toner image of a predetermined color component to prevent misregistration of image formation in transfer by the transfer unit, comprising: a detection step of detecting a position where a toner image of a color component other than the color component of the misregistration prevention pattern and the toner image of the misregistration prevention pattern overlap each other on the surface of the image carrier; and a control step of controlling to form the misregistration prevention pattern on the surface of the image carrier except for the overlapping position detected in the detection step, and not to form the misregistration prevention pattern at the overlapping position on the surface of the image carrier.

The present invention can keep constant slipperiness between an image carrier and a transfer medium. The present invention can prevent an image failure such as a local image stretch or shrinkage or an image streak arising from a toner image between the image carrier and the transfer medium in transferring the toner image. No misregistration prevention dot is printed at a portion where a print image dot exists. High image quality can therefore be provided without roughness.

Further features of the present invention will become apparent from the following description of exemplary embodiments (with reference to the attached drawings).

DESCRIPTION OF THE EMBODIMENTS

<First Embodiment>

Figure 1:
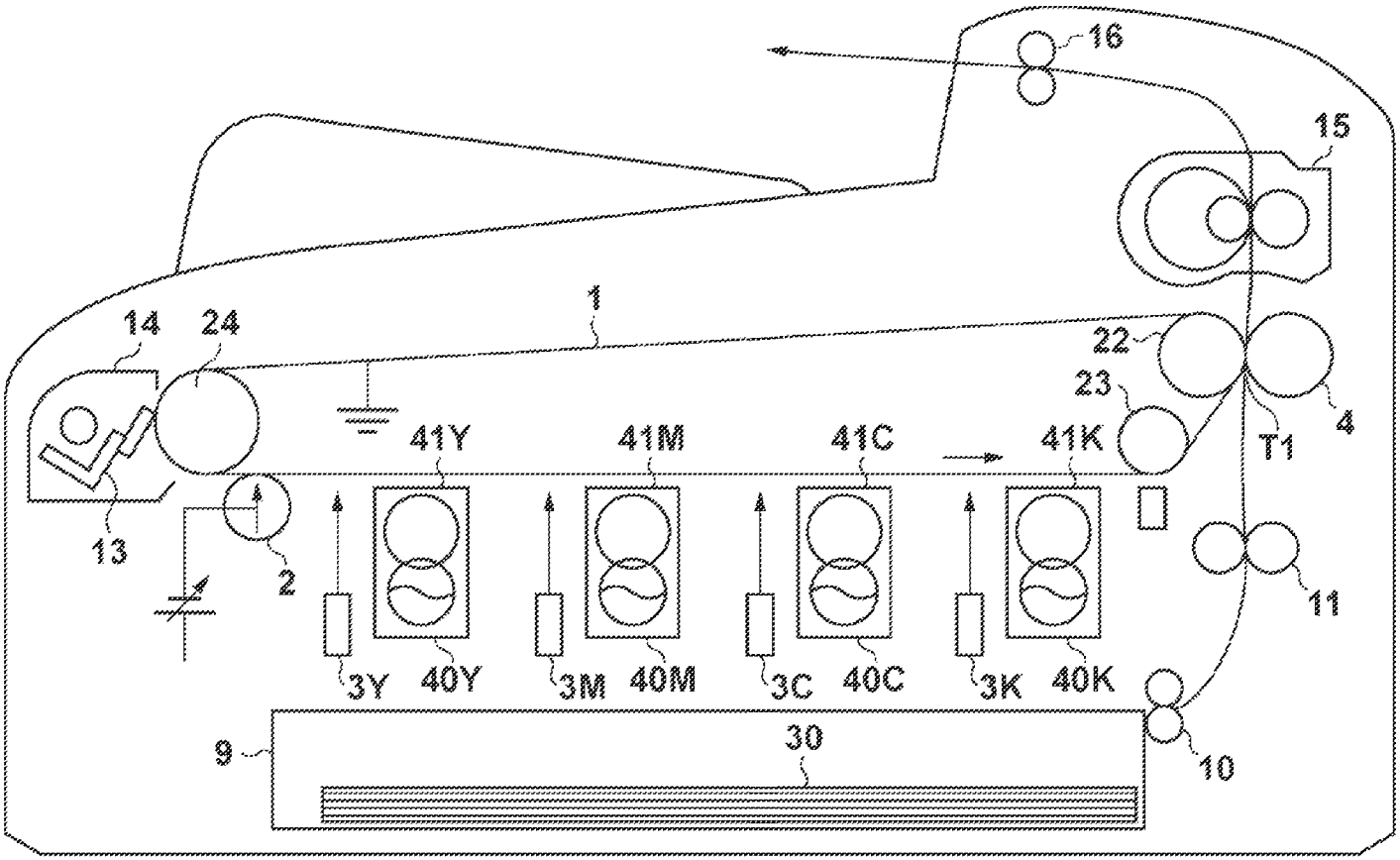
FIG. 1 is a sectional view showing the schematic arrangement of an image forming apparatus according to the first embodiment.

The first embodiment of the present invention will be described below with reference to the accompanying drawings. Note that the same reference numerals denote the same or corresponding parts throughout the drawings of the following embodiments. First, a copying apparatus will be explained as an image forming apparatus according to the first embodiment of the present invention. FIG. 1 shows the schematic arrangement of the copying apparatus according to the first embodiment of the present invention.

(Arrangement of Image Carrier)

As shown in FIG. 1, the image forming apparatus according to the first embodiment includes an image carrier 1. The arrangement of an electrophotographic photosensitive member will be described in detail as the image carrier according to the embodiment. The electrophotographic photosensitive member according to the embodiment is applicable to both a single layer type in which a single photosensitive layer contains both a charge transport material and charge generation material and a multilayered type in which the photosensitive layer is separated into a charge transport layer and charge generation layer. However, the multilayered type is more preferable in terms of electrophotographic characteristics.

A conductive substrate used in the electrophotographic photosensitive member suffices to be conductive. Examples of the material are a metal such as aluminum or stainless steel, a metal with a conductive layer, paper, and plastic. Examples of the shape of the conductive substrate are a sheet and cylinder. The embodiment employs an aluminum endless sheet for space saving.

When an image input is a laser beam, like a digital copying apparatus, a conductive layer may be formed to prevent an interference fringe generated by scattering or cover a scratch of the substrate. The conductive layer can be formed by dispersing a conductive powder of carbon black, metal particles, or the like into a binder resin. The conductive layer is formed to have a film thickness of 5 to 40 μm, and preferably, 10 to 30 μm.

An intermediate layer having a bonding function is formed on the conductive layer. Examples of the material of the intermediate layer are polyamide, polyvinyl alcohol, polyethylene oxide, ethylcellulose, casein, polyurethane, and polyether urethane. The material of the intermediate layer is dissolved in a proper solvent and applied. The intermediate layer is formed to have a film thickness of 0.05 to 5 μm, and preferably, 0.3 to 1 μm.

A charge generation layer is formed on the intermediate layer. Examples of the material of the charge generation layer used in the embodiment are selenium-tellurium, pyrylium, and thiapyrylium dyes, and phthalocyanine, anthoanthrone, dibenzpyrenequinone, trisazo, cyanine, disazo, monoazo, indigo, quinacridone, and asymmetrical quinocyanine pigments.

For the function-separated multilayered type in which the charge transport layer and charge generation layer are separated, a charge generation material is properly dispersed together with 0.3 to 4 times amount of binder resin and solvent by a method such as a homogenizer, ultrasonic dispersion, ball mill, vibrating ball mill, sand mill, attritor, roll mill, or high-speed liquid collision disperser. The dispersion prepared by the above method is applied and dried, forming a charge generation layer. The charge generation layer is formed to have a film thickness of 5 μm or less, and preferably, 0.1 to 2 μm.

The charge transport layer is formed by applying and drying a coating prepared by mainly dissolving, in a solvent, a binder resin and charge transport material according to the embodiment. Examples of the charge transport material used are a triarylamine compound, hydrazone compound, stilbene compound, pyrazoline compound, oxazole compound, triarylmethane compound, and thiazole compound.

The material of the charge transport layer is applied and dried together with 0.5 to 2 times amount of binder resin, forming a charge transport layer. The charge transport layer is formed to have a film thickness of 5 to 40 μm, and preferably, 15 to 30 μm.

The image carrier 1 is looped between a driving roller 22 which transfers driving to the image carrier 1, a driven roller 23 which is driven by circulation of the image carrier 1, and a tension roller 24 which faces a cleaning blade 13 via the image carrier 1. The driving roller 22 faces a transfer roller 4 via the image carrier 1. The driving roller 22 prevents a slip on the image carrier 1 by coating the surface of a metal roller with a rubber (urethane or chloroprene) several mm thick. The driving roller 22 is driven to rotate by a pulse motor (not shown) in a direction (counterclockwise) indicated by an arrow.

The image carrier 1 forms a flat portion between the tension roller 24 and the driven roller 23. A primary charger 2 serving as a charging unit, and developing sleeves 41Y, 41M, 41C, and 41K of developing units 40Y, 40M, 40C, and 40K serving as developing units are arranged side by side at the flat portion.

The transfer roller 4 serving as a transfer unit, and a cleaning device 14 having the cleaning blade 13 as a residual removing unit are sequentially arranged near the image carrier 1. The transfer roller 4 is arranged to face the driving roller 22, and forms a transfer region T1 at a nip between the transfer roller 4 and the image carrier 1. At this time, the transfer roller 4 is pressed against the image carrier 1 at an appropriate pressure.

An optical system is arranged below the image carrier 1 in the image forming apparatus according to the embodiment. The optical system irradiates the surface of the image carrier 1 with light beams from exposure units 3Y, 3M, 3C, and 3K in correspondence with a document image obtained by scanning.

A paper feed cassette 9 serving as a paper feed unit is arranged at the uppermost stream of the transfer roller 4. A pickup roller 10 and registration roller 11 feed a transfer medium 30 as a recording medium from the paper feed cassette 9. The transfer medium 30 is conveyed to the transfer region T1 where the driving roller 22 and transfer roller 4 face each other.

A fixing unit 15 is arranged downstream of the transfer roller 4. Further, a discharge unit formed from discharge rollers 16 and discharge tray is arranged downstream of the fixing unit 15 to discharge the transfer medium 30 from the apparatus.

In the copying apparatus having the above arrangement according to the embodiment, first, the primary charger 2 charges the surface of the image carrier 1 driven by a motor. The region charged by the primary charger 2 is irradiated with light from the exposure unit 3Y, forming an electrostatic latent image on the surface of the image carrier 1.

The developing sleeve 41Y serving as a developer carrier for the yellow developing unit 40Y rotates, and the electrostatic latent image formed by the exposure unit 3Y is developed with the toner and visualized as a yellow toner image. Similarly, the developing sleeves 41M, 41C, and 41K respectively visualize a magenta toner image corresponding to an electrostatic latent image formed by the exposure unit 3M, a cyan toner image corresponding to an electrostatic latent image formed by the exposure unit 3C, and a black toner image formed by the exposure unit 3K.

The toner images visualized on the surface of the image carrier 1 sequentially reach the transfer region T1 as the image carrier 1 rotates. The registration roller 11 sends the conveyed transfer medium 30 to the transfer region T1 in synchronization with the toner images on the image carrier 1. The transfer roller 4 transfers the toner images. Subsequently, the fixing unit 15 fixes the toner images onto the transfer medium 30 bearing them. After that, the transfer medium 30 is discharged from the apparatus via the discharge rollers 16.

The cleaning blade 13 of the cleaning device 14 scrapes, as a residual from the surface of the image carrier 1, the developer remaining on the surface of the image carrier 1 after toner image transfer. The scraped developer is supplied to a recovery toner container.

(Control Block Diagram)

In the embodiment, a misregistration prevention pattern is formed with yellow toner out of toners of the respective color components. The misregistration prevention pattern is a dot pattern used to prevent misregistration between the image carrier and a transfer medium in transfer. Details of the misregistration prevention pattern will be described later with reference to FIGS. 3 and 4. Each dot contained in the misregistration prevention pattern will also be referred to as a misregistration prevention dot.

Figure 2:
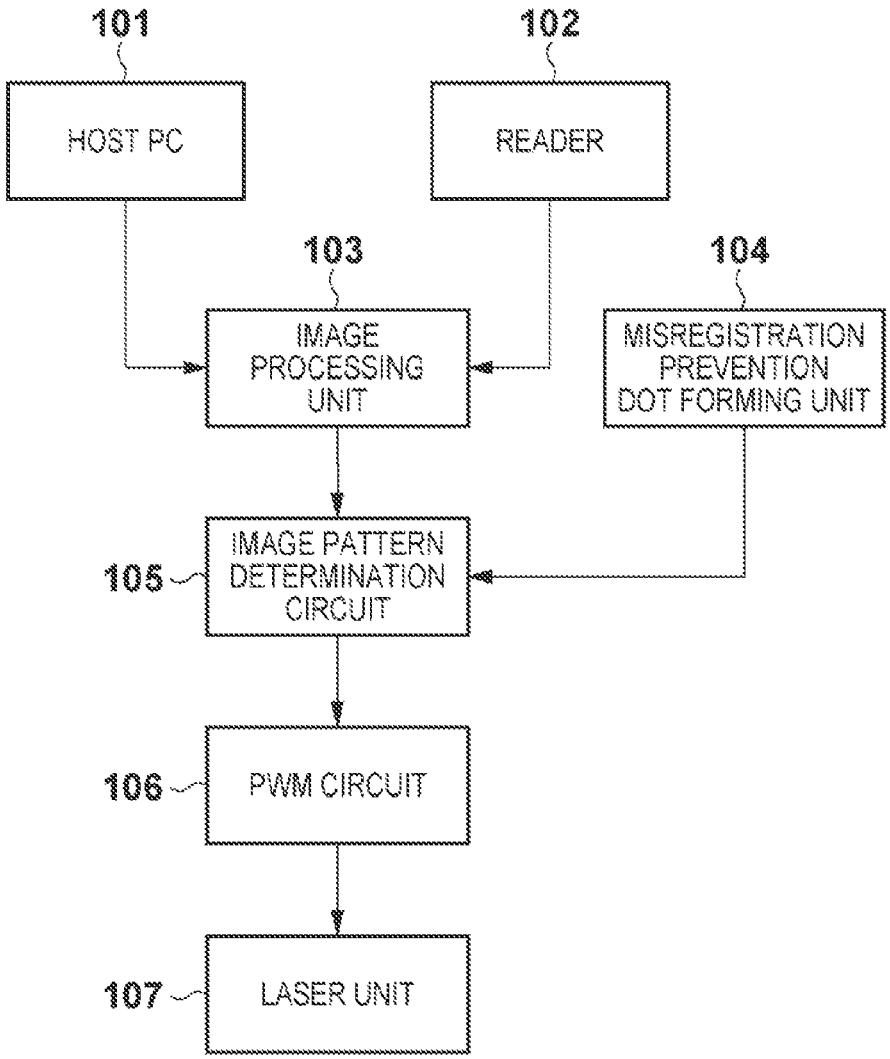
FIG. 2 is a control block diagram showing an image forming operation according to the first embodiment.

Image data to be input to the exposure unit 3Y is generated as shown in the block diagram of FIG. 2. External information input from a host PC 101 or reader (image reading unit) 102 to form a print image is processed by an image processing unit 103, and output as a normal image signal for driving a laser unit 107 which acts on the exposure units 3Y to 3K. A misregistration prevention dot forming unit 104 generates a dot pattern signal for forming, as a misregistration prevention pattern, a dot pattern in which a toner image of small dots is distributed.

Figure 3:
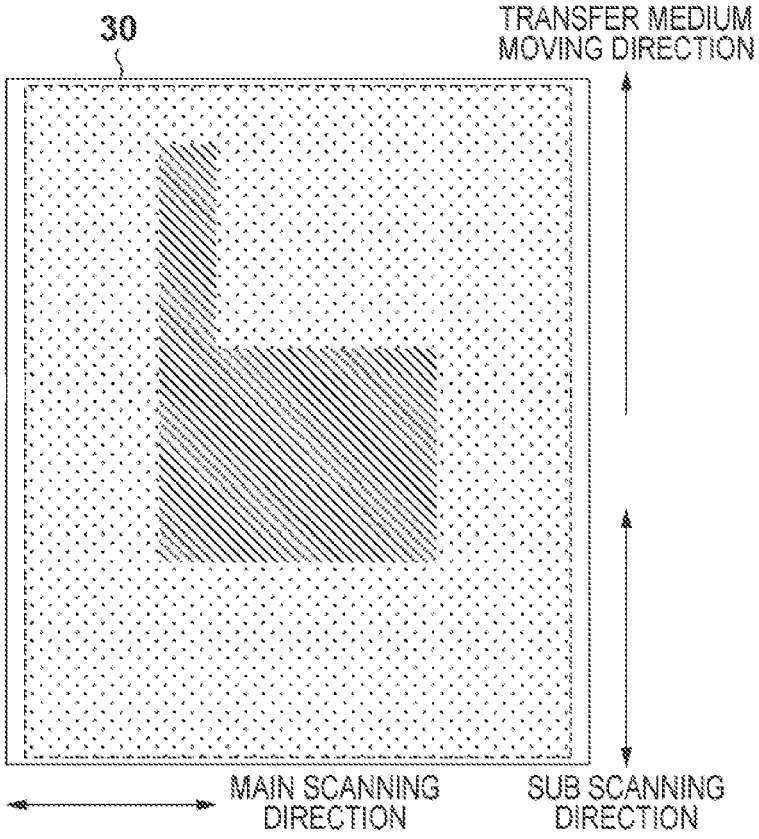
FIG. 3 is a view for explaining an image pattern on a transfer medium when misregistration prevention dots are formed.

Exposure image information obtained by compositing the dot pattern signal acquired from the misregistration prevention dot forming unit 104 and image pattern information contained in a print image signal acquired from the image processing unit 103 is sent to a PWM circuit 106 via an image pattern determination circuit 105. The PWM circuit 106 converts the exposure image information into a pulse width signal in accordance with a PWM table for generating a pulse width corresponding to exposure image information. The PWM circuit 106 sends the pulse width signal to the laser unit 107. A toner image to be formed on the image carrier 1 is obtained by superposing a normal print image and misregistration prevention pattern, as shown in FIG. 3. Assume that the PWM table for conversion into a pulse width signal is defined in advance.

(Control Flowchart)

The flowchart of an image forming operation when forming a misregistration prevention pattern in the embodiment will be explained. In the embodiment, the respective building components shown in FIG. 2 implement this processing. However, each building component described as a circuit may be implemented by a program to be executed by the CPU (not shown) of the image forming apparatus. As will be described later, overlapping of a print image pattern and misregistration prevention pattern is determined using the result of detecting whether the color component of the misregistration prevention pattern and that of the print image pattern overlap each other. In the embodiment, the color component of the misregistration prevention pattern is yellow, so the determination is made based on whether the yellow component overlaps the remaining color components.

Figure 5:
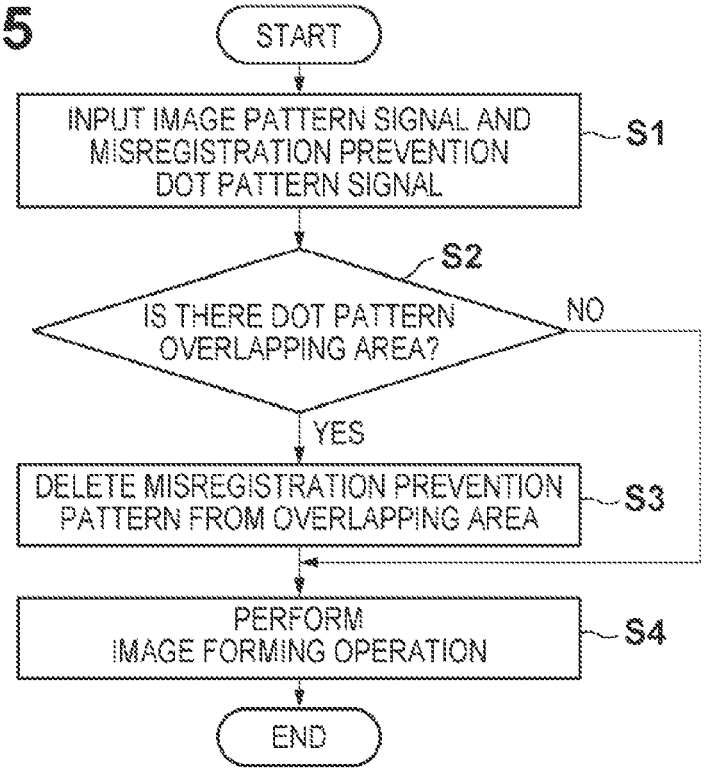
FIG. 5 is a flowchart showing an image forming operation according to the first embodiment.

As shown in FIG. 5, the image processing unit 103 receives external information which is input from the host PC 101 or reader (image reading unit) 102 to form an input print image. The image pattern determination circuit 105 receives a print image pattern generated by the image processing unit 103. In addition, the image pattern determination circuit 105 receives even a preset misregistration prevention pattern signal from the misregistration prevention dot forming unit 104 (step S1). The image pattern determination circuit 105 determines whether there is an area where the print image pattern and misregistration prevention pattern overlap each other on the image carrier (step S2). This determination implements a detection unit. If the print image pattern and misregistration prevention pattern overlap each other (YES in step S2), the image pattern determination circuit 105 forms an exposure image signal (exposure image information) by deleting the misregistration prevention pattern from the overlapping area (step S3). The process then shifts to step S4. If the print image pattern and misregistration prevention pattern do not overlap each other (NO in step S2), the process shifts to step S4. The exposure units 3Y to 3K form latent image patterns in accordance with pulse width signals generated by the PWM circuit 106 based on the exposure image signal, and execute the above-described image forming operation (step S4). That is, the misregistration prevention pattern is formed at a position except for one at which the print image pattern and misregistration prevention pattern overlap each other. After that, the processing sequence ends.

(Misregistration Prevention Pattern)

FIG. 3 shows a normal print image region and misregistration prevention pattern area formed on the transfer medium 30 at timings according to the above control sequence. Note that a direction in which a laser beam emitted by the exposure unit 3 scans, that is, a direction perpendicular to the moving direction (traveling direction) of the image carrier 1 will be called a main scanning direction, and a direction in which the image carrier 1 moves will be called a sub scanning direction.

Almost all the transfer medium area (transfer medium region) is the misregistration prevention pattern area (region) according to the embodiment. A print image is a hatched image (L-shaped portion at the center of the image) in FIG. 3.

Figure 4:
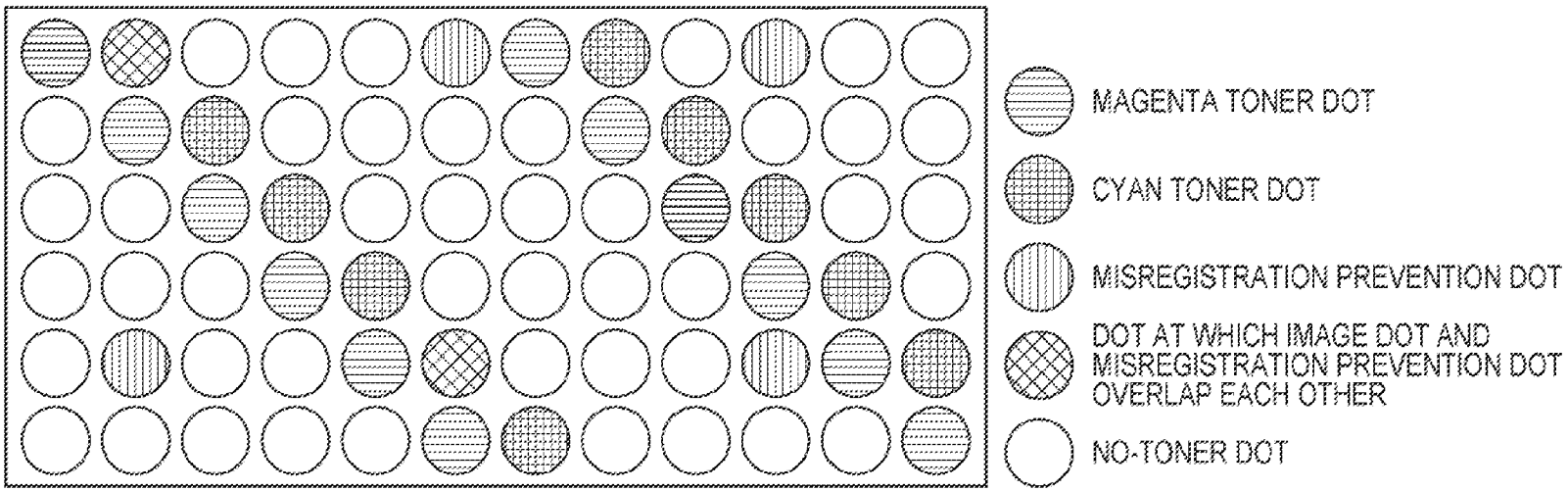
FIG. 4 is a view for explaining a toner layout in a dot matrix which forms each pixel.

FIG. 4 shows a toner layout in a dot matrix which forms each pixel in the print image region described with reference to FIG. 3. FIG. 4 shows magenta toner dots, cyan toner dots, and misregistration prevention pattern dots (yellow). Also, FIG. 4 shows positions where image dots (magenta and cyan) and misregistration prevention pattern dots overlap each other. Note that the embodiment exemplifies a misregistration prevention pattern of one color (yellow). For example, an image forming apparatus capable of handling a plurality of colors may form a misregistration prevention pattern in a plurality of colors.

As described in Description of the Related Art, frictional force is generally generated between the image carrier 1 and the transfer medium 30, and the magnitude of frictional force changes depending on whether toner exists between the image carrier 1 and the transfer medium 30. That is, slipperiness between the image carrier 1 and the transfer medium 30 changes. When the moving velocity of the image carrier 1 decreases with respect to the transfer medium 30 owing to slipperiness, the print image stretches in the sub scanning direction, or image exposure on the image carrier 1 blurs, generating an image streak at the leading end of the image. To the contrary, when the moving velocity of the transfer medium 30 changes to be lower with respect to the image carrier 1, the print image shrinks in the sub scanning direction.

According to the present invention, no gap exists in the dot pattern region regardless of the print image pattern shape. The frictional force between the image carrier 1 and the transfer medium 30 does not abruptly vary even upon a change from a toner absent portion to a toner present portion at the transfer nip. This can relax variations of the moving velocities of the image carrier 1 and transfer medium 30. The first embodiment can more stably form an image.

Note that the embodiment has exemplified image pattern formation using a dot matrix. However, the present invention is applicable to even image pattern formation using a screen.

<Second Embodiment>

In the second embodiment, when dots of a print image pattern and misregistration prevention pattern overlap each other, the dot is laid out at another position. An image forming apparatus used in the second embodiment has the same arrangement as that in the first embodiment, unless otherwise specified.

The frictional force between an image carrier 1 and a transfer medium 30 is determined by the amount of toner present at the nip between them. It suffices that a predetermined amount or more of toner exists in the entire area in the main scanning direction and at a position (transfer region T1) in the sub scanning direction where the image carrier 1 and transfer medium 30 form a nip. The predetermined amount or more indicates a dot count which is equal to or larger than a predetermined toner dot count. When shifting the position of a misregistration prevention dot, a dot is formed in the same nip forming region as a corresponding dot print position. More specifically, the position is desirably shifted in the main scanning direction to form a misregistration prevention dot.

(Control Flowchart)

Figure 6:
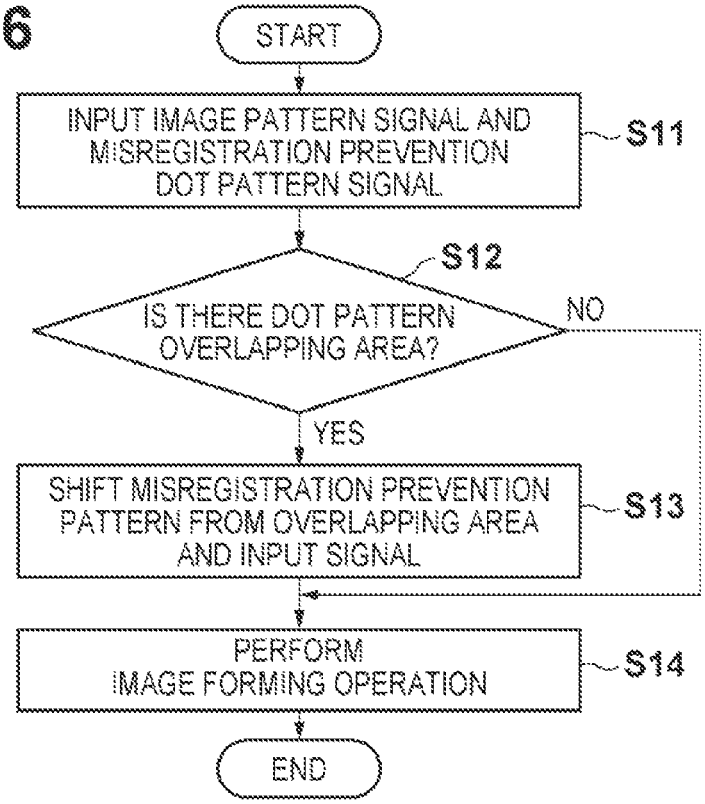
FIG. 6 is a flowchart showing an image forming operation according to the second embodiment.

The sequence of an image forming operation to form a misregistration prevention pattern will be explained with reference to the flowchart of FIG. 6. In the embodiment, the respective building components shown in FIG. 2 implement this processing. However, each building component described as a circuit may be implemented by a program to be executed by the CPU (not shown) of the image forming apparatus.

First, an image processing unit 103 receives external information which is input from a host PC 101 or reader (image reading unit) 102 to form an input print image. An image pattern determination circuit 105 receives a print image pattern generated by the image processing unit 103. In addition, the image pattern determination circuit 105 receives even a preset misregistration prevention pattern signal from a misregistration prevention dot forming unit 104 (step S11). The image pattern determination circuit 105 determines whether there is an area where the print image pattern and misregistration prevention pattern overlap each other on the image carrier 1 (step S12). This determination implements a detection unit. If the print image pattern and misregistration prevention pattern overlap each other (YES in step S12), the image pattern determination circuit 105 forms an exposure image signal (exposure image information) by shifting a misregistration prevention pattern dot from the overlapping area to a neighboring area (step S13). In the embodiment, when shifting a misregistration prevention pattern dot, the image pattern determination circuit 105 shifts it in the main scanning direction from the position where the dot exists, to prevent misregistration. At this time, a positive or negative direction is arbitrary as long as the dot is shifted in the main scanning direction. The process then shifts to step S14. If the print image pattern and misregistration prevention pattern do not overlap each other (NO in step S12), the process shifts to step S14. Exposure units 3Y, 3M, 3C, and 3K form latent image patterns in accordance with pulse width signals generated by a PWM circuit 106 based on the exposure image signal, and execute the above-described image forming operation (step S14). Thereafter, the processing sequence ends.

Similar to the first embodiment, the second embodiment can stably form an image.

<Third Embodiment>

According to the feature of the third embodiment, when the toner image dot count of a print image pattern in the main scanning direction is equal to or larger than a predetermined count, no misregistration prevention pattern dot is formed at a position in the main scanning direction. An image forming apparatus according to the third embodiment has the same arrangement as that in the first embodiment, unless otherwise specified.

Figure 7:
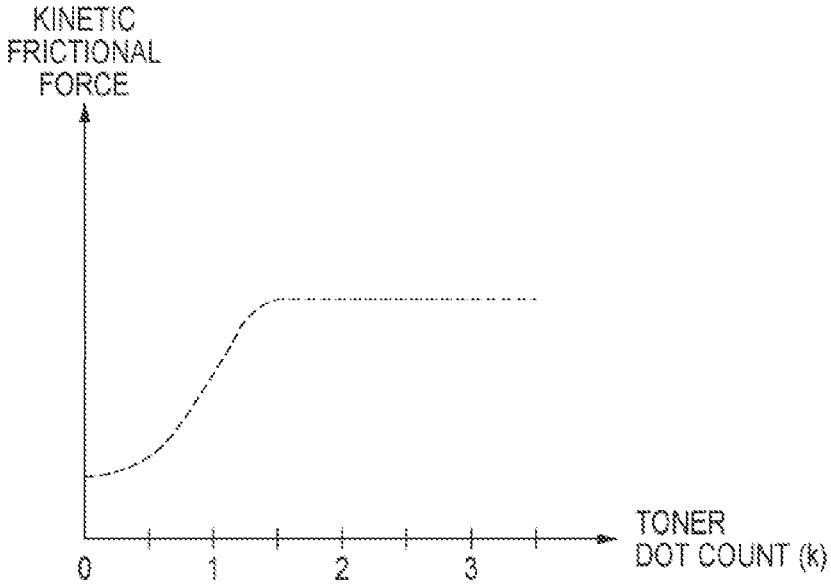
FIG. 7 is a graph exemplifying a change of the frictional force between an image carrier and a transfer medium when a developer intervenes between them according to the third embodiment.

FIG. 7 is a graph showing a change of the kinetic frictional force between an image carrier 1 and a transfer medium 30 with respect to the toner image dot count when A4 landscape coated paper passes between the image carrier 1 and a transfer roller 4 which is pressed against the image carrier 1 at a total pressure of 1 kgf. The toner image dot count in the main scanning direction is about 600 dpi. As is apparent from the result in FIG. 7, when the toner image dot count in the main scanning direction is equal to or larger than a predetermined count, neither kinetic frictional force changes nor misregistration occurs. An experimentally obtained value is referred to and held in advance as a predetermined count.

(Control Flowchart)

Figure 8:
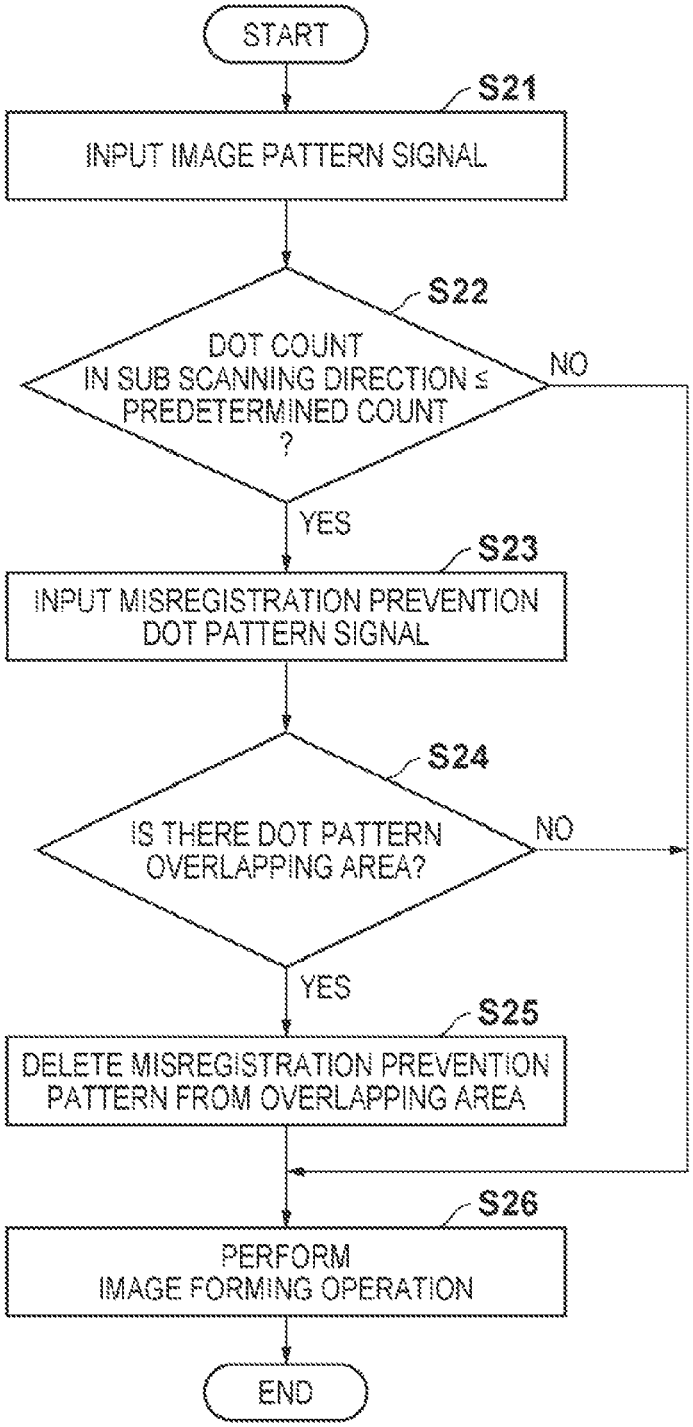
FIG. 8 is a flowchart showing the image forming operation of an image forming apparatus according to the third embodiment.

The sequence of an image forming operation to form a misregistration prevention pattern will be explained with reference to the flowchart of FIG. 8. In the embodiment, the respective building components shown in FIG. 2 implement this processing. However, each building component described as a circuit may be implemented by a program to be executed by the CPU (not shown) of the image forming apparatus.

First, an image processing unit 103 receives external information which is input from a host PC 101 or reader (image reading unit) 102 to form an input print image. An image pattern determination circuit 105 receives a print image pattern generated by the image processing unit 103. In addition, the image pattern determination circuit 105 receives even a preset misregistration prevention pattern signal from a misregistration prevention dot forming unit 104 (step S21). The image pattern determination circuit 105 determines whether the dot count of the print image pattern in the main scanning direction is equal to or smaller than a predetermined value (step S22). If the dot count is equal to or smaller than the predetermined value (YES in step S22), the image pattern determination circuit 105 inputs a misregistration prevention pattern signal set in advance in the main scanning direction (step S23). The process then advances to step S24. If the dot count is larger than the predetermined value (NO in step S22), the process advances to step 526.

The image pattern determination circuit 105 determines whether there is an area where the print image pattern and misregistration prevention pattern overlap each other on the image carrier (step S24). If the print image pattern and misregistration prevention pattern overlap each other (YES in step S24), the image pattern determination circuit 105 forms an exposure image signal by deleting the misregistration prevention pattern from the overlapping area (step S25). If the print image pattern and misregistration prevention pattern do not overlap each other (NO in step S24), the process shifts to step S26. Exposure units 3Y, 3M, 3C, and 3K form latent image patterns in accordance with pulse width signals generated by a PWM circuit 106 based on the exposure image signal, and execute the above-described image forming operation (step S26). If the dot count of the print image in the main scanning direction is larger than the predetermined value (NO in step S22), no misregistration prevention pattern dot need be printed. Hence, the exposure units 3Y to 3K perform the image forming operation in accordance with pulse width signals in which no misregistration prevention pattern signal is composited with the print image pattern (step S26). After that, the processing sequence ends.

In addition to the effects of the first embodiment, the third embodiment can reduce the developer consumption amount without printing an unnecessary misregistration prevention dot.

Aspects of the present invention can also be realized by a computer of a system or apparatus (or devices such as a CPU or MPU) that reads out and executes a program recorded on a memory device to perform the functions of the above-described embodiment(s), and by a method, the steps of which are performed by a computer of a system or apparatus by, for example, reading out and executing a program recorded on a memory device to perform the functions of the above-described embodiment(s). For this purpose, the program is provided to the computer for example via a network or from a recording medium of various types serving as the memory device (for example, computer-readable medium).

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2010-251276, filed Nov. 9, 2010, which is hereby incorporated by reference herein in its entirety.

What is claimed is:

1. An image forming apparatus which includes an image carrier, a charging unit that charges a surface of the image carrier, exposure units that form latent images of respective color components on the surface of the image carrier, developing units that develop the latent images formed by the exposure units into toner images, and a transfer unit that transfers the toner images onto a transfer medium, and which forms a misregistration prevention pattern by a toner image of a predetermined color component to prevent misregistration of image formation in transfer by the transfer unit, comprising:

a detection unit configured to detect a position where a toner image of a color component other than the color component of the misregistration prevention pattern and the toner image of the misregistration prevention pattern overlap each other on the surface of the image carrier; and a control unit configured to control to form the misregistration prevention pattern on the surface of the image carrier except for the overlapping position detected by said detection unit, and not to form the misregistration prevention pattern at the overlapping position on the surface of the image carrier, said control unit further configured to control to shift, to a position where a toner image in a main scanning direction does not overlap toners of the respective color components, the misregistration prevention pattern at the position where the misregistration prevention pattern overlaps the toners of the respective color components and form the misregistration prevention pattern.

2. The apparatus according to claim 1, wherein when the number of dots which form the toner image is not larger than a predetermined value in the main scanning direction of the image carrier, said control unit controls to form the misregistration prevention pattern except for the position where the toner image of the color component other than the color component forming the misregistration prevention pattern and the toner image of the misregistration prevention pattern overlap each other in the main scanning direction.

3. An image forming method in an image forming apparatus which includes an image carrier, a charging unit that charges a surface of the image carrier, exposure units that form latent images of respective color components on the surface of the image carrier, developing units that develop the latent images formed by the exposure units into toner images, and a transfer unit that transfers the toner images onto a transfer medium, and which forms a misregistration prevention pattern by a toner image of a predetermined color component to prevent misregistration of image formation in transfer by the transfer unit, comprising:

a detection step of detecting a position where a toner image of a color component other than the color component of the misregistration prevention pattern and the toner image of the misregistration prevention pattern overlap each other on the surface of the image carrier; and a control step of controlling to form the misregistration prevention pattern on the surface of the image carrier except for the overlapping position detected in the detection step, and not to form the misregistration prevention pattern at the overlapping position on the surface of the image carrier, wherein the control step further controls to shift, to a position where a toner image in a main scanning direction does not overlap toners of the respective color components, the misregistration prevention pattern at the position where the misregistration prevention pattern overlaps the toners of the respective color components, and form the misregistration prevention pattern.

* * * * *